United States Patent [19]

Fletcher

[11] 3,934,359

[45] Jan. 27, 1976

[54] REINFORCING ELEMENTS FOR SHOE SOLES AND HEELS

[75] Inventor: John Fletcher, New York, N.Y.

[73] Assignee: Lawrence Peska Associates, Inc., New York, N.Y. ; a part interest

[22] Filed: Aug. 19, 1974

[21] Appl. No.: 498,436

[52] U.S. Cl. ..... 36/73

[51] Int. Cl.[2] ..... A43B 13/22

[58] Field of Search..... 36/72, 71.5, 73, 25 R, 36/33, 36 A, 67 R, 67 A

[56] References Cited

UNITED STATES PATENTS

| | | | |
|---|---|---|---|
| 341,347 | 5/1886 | Pierce | 36/73 |
| 999,566 | 8/1911 | Jeffre | 36/73 |
| 1,776,750 | 9/1930 | Burns | 36/25 R |
| 1,875,152 | 8/1932 | Reynolds | 36/73 |
| 2,181,110 | 11/1939 | Esser | 36/36 A |
| 3,235,980 | 2/1966 | Hawkins et al. | 36/36 A |

FOREIGN PATENTS OR APPLICATIONS

| | | | |
|---|---|---|---|
| 761,501 | 1/1934 | France | 36/33 |
| 1,052,743 | 9/1953 | France | 36/73 |
| 27,823 | 1904 | United Kingdom | 36/67 A |
| 419,012 | 3/1947 | Italy | 36/73 |

*Primary Examiner*—Alfred R. Guest

*Attorney, Agent, or Firm*—Richard E. Nanfeldt

[57] ABSTRACT

Reinforcing elements for shoe soles and heels, wherein the reinforcing elements are detachably mounted in a spaced configuration to the bottom base of the shoe sole or heel. The reinforcing elements extend the life of the sole or heel, as well as reduce heat build up within the shoe by providing an air cushion beneath the shoe sole.

7 Claims, 7 Drawing Figures

FIG. 1
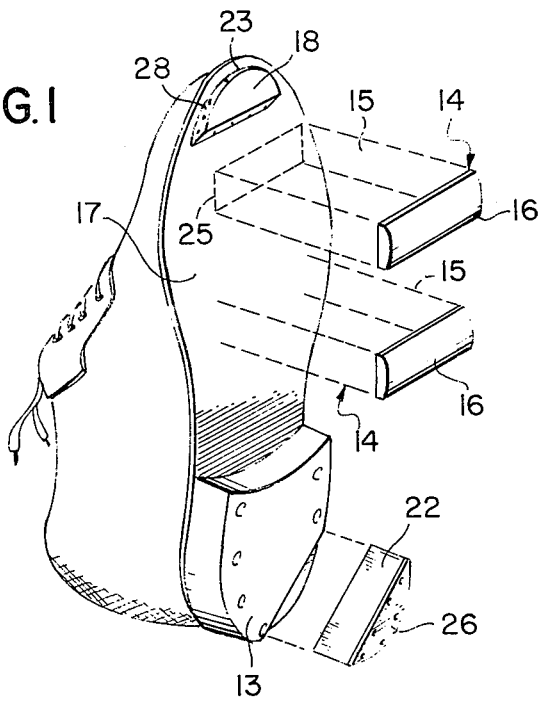
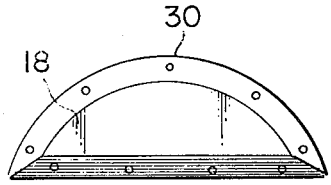
FIG. 6
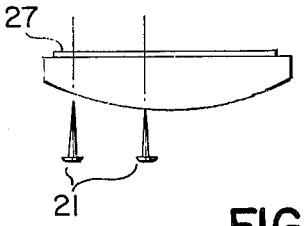
FIG. 2
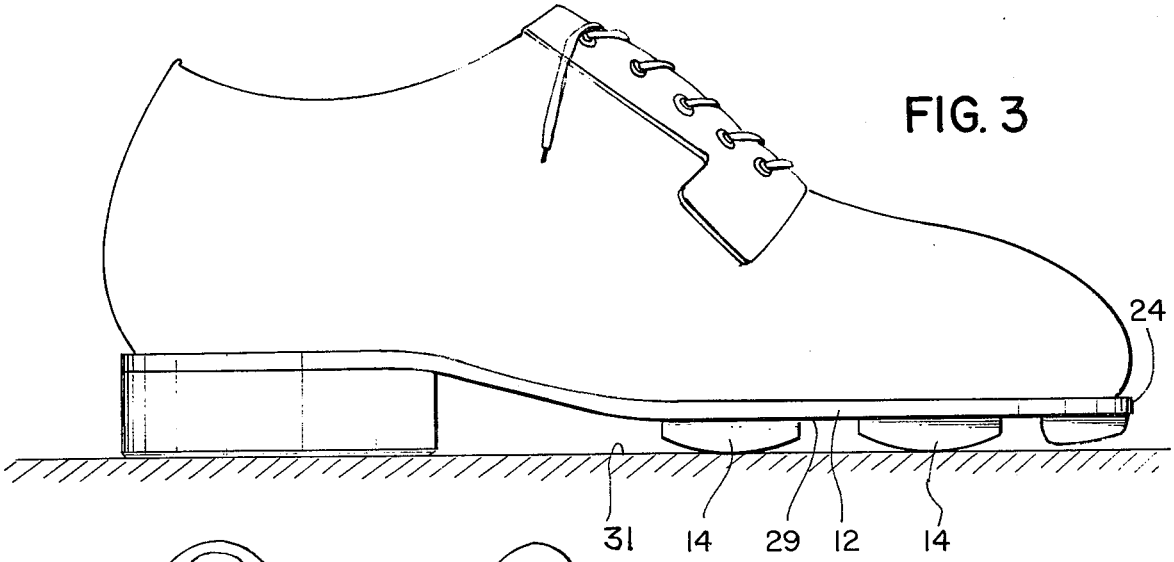
FIG. 3
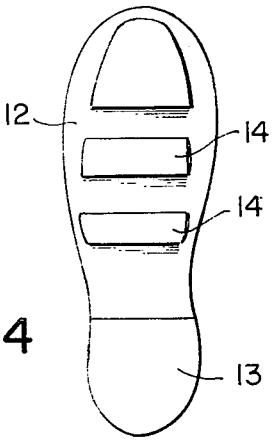
FIG. 4
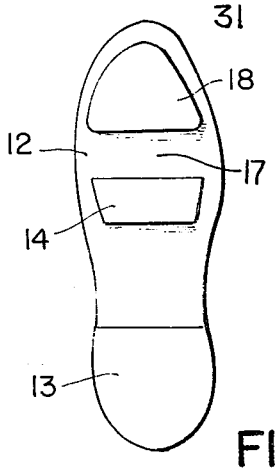
FIG. 5
FIG. 7
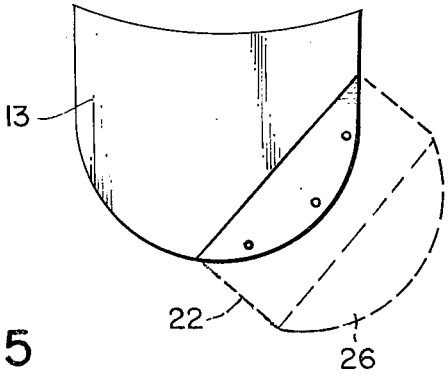

REINFORCING ELEMENTS FOR SHOE SOLES AND HEELS

SUMMARY OF THE INVENTION

My invention relates to a unique and novel concept of reinforcing elements for a shoe sole or heel detachably mounted in a spaced configuration to the bottom base of a shoe sole or heel. The primary object of my invention is to provide detachably mounted reinforcing elements so as to extend the life of a shoe sole or heel.

It is known from U.S. Pat. Nos. 1,929,126; 2,089,170; 2,434,770; 2,468,886; and 3,114,981 that improvements have been made in shoe soles, but not as a detachably mounted reinforcing element in a spaced configuration, nor do they provide for the restoration of a worn out shoe sole.

The major advantage of my invention is that it provides a means of increasing the life expectancy of a shoe sole or heel.

A plurality of reinforcing elements are detachably mounted in a spaced configuration to the bottom of the shoe sole or heel. The reinforcing elements are comprised of three dimensional shaped members made from rubber, plastic or leather materials. The configuration of these reinforcing elements are: a wedge, a semicylinder or a modified rectangular box, wherein the modification consists of a rocker shaped lateral base. The wedged shaped or semi-cylinder shaped reinforcing elements are mounted onto the shoe heel while the wedged shaped element is mounted onto the toe section of the shoe sole. The modified rectangular shaped elements are mounted on each side of the center of the shoe sole. A means is provided for the mounting of the reinforcing elements to the bottom base of the shoe sole or heel. This means comprises either a plurality of nails or screws or a pressure sensitive adhesive between the shoe sole or heel and the reinforcing element.

BRIEF DESCRIPTION OF THE DRAWINGS

The objects and features of the invention may be understood with reference to the following detailed description of an illustrative embodiment of the invention, taken together with the accompanying drawings in which:

FIG. 1 illustrates a perspective view of the reinforcing elements detached from the shoe sole and heel;

FIG. 2 illustrates a side view of the attachment by means of the reinforcing elements;

FIG. 3 illustrates a side elevated view of the reinforcing element in an attached state to the shoe;

FIG. 4 illustrates a bottom view of the reinforcing element in an attached state to the shoe;

FIG. 5 illustrates a bottom view of a modification of the attachment of the reinforcing element to the shoe;

FIG. 6 illustrates a bottom view of the toe member; and

FIG. 7 illustrates a bottom view of the heel member.

DESCRIPTION OF THE PREFERRED EMBODIMENT

Turning now descriptively to the drawings, in which similar reference characters denote similar elements throughout the several views, FIGS. 1, 3, 4, 5, 7 illustrate the reinforcing elements 14, 18, 22 detachably attached to the bottom base 29 of the sole 12 and heel 13 of a shoe 11. The toe positioned sole reinforcement element 18 as shown in FIGS. 1, 3, 6 is formed in the shape of a wedge 28, wherein the tapered end 23 of the wedge 28 is of a convex curvative 30. The tapered end 23 of the wedge 28 is aligned toward the front edge 24 of the sole 12. The center sole reinforcing elements 14 are formed in the shape of a modified rectangular box member 15, wherein the modification consists essentially of the formation of one lateral rocker shaped base 16. The second lateral base 25 of the rectangular box member 15 is planar. The lateral flat base 25 of member 14 affixes to the bottom base 29 of the sole 12 such that the rocker shaped base 16 engages the ground 31. Element 14 and element 18 can be attached to the bottom base 29 of the sole 12 on either side of the bend area 17 of the sole 12 as shown in FIG. 5. Two elements 14 can be positioned on the sole 12 as shown in FIG. 4. Referring back to FIGS. 1 and 7 the heel reinforcing element 22 is formed in the shape of a semi-cylinder with two flat lateral bases 26.

FIG. 2 shows the detachable mounting means of the reinforcing elements 14, 18, 22 to the sole 12 of heel 13 of the shoe 11, wherein a pressure sensitive adhesive layer 27 is compressed between the reinforcing elements 14, 18 and 22 and the sole 12 or heel 13 of the shoe 11. A plurality of screws or nails 21 are driven upward through the reinforcing element 14, 18, 22 into the sole 12 or heel 13 of the shoe 11.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A plurality of reinforcing elements adapted to be affixed to a sole and a heel of a shoe for providing protection to said sole and heel, and providing a means for walking easily in a soft area, which comprises:

a. a toe positioned sole reinforcement element affixed onto a toe portion of said sole;

b. a heel reinforcing element fitted into a cut out segment of said heel c. a pair of center sole reinforcing elements, one of said pair of said center sole reinforcing elements mounted transversely across said sole just forwardly of a bend area of said sole, the other of said pair of said center sole reinforcing elements mounted transversely across said sole just rearwardly of said bend area of said sole, each said center sole reinforcing element having a rectangular box shaped with a rocker shaped lateral base, and said lateral base adapted to engage said ground.

2. A plurality of reinforcing elements according to claim 1, wherein said toe positioned sole reinforcing element is circular segment shape.

3. A plurality of reinforcing elements according to claim 2, wherein said heel reinforcing element is of a cylindrical segment shape.

4. A plurality of reinforcing elements according to claim 2, wherein said heel reinforcing element is circular segment shape.

5. A plurality of reinforcing elements according to claim 1, wherein the composition of each said reinforcing element is selected from the group consisting of synthetic plastic, rubber, or leather.

6. A plurality of reinforcing elements according to claim 1, wherein each said reinforcing element is joined to said sole or heel by adhesive means.

7. A plurality of reinforcing elements according to claim 1, wherein each said reinforcing element is joined to said sole or heel by nail means.

* * * * *